US010975575B2

(12) United States Patent
Morris

(10) Patent No.: US 10,975,575 B2
(45) Date of Patent: Apr. 13, 2021

(54) CONSTRUCTION PANEL MOUNTING APPARATUS

(71) Applicant: Armen Artinyan, Burbank, CA (US)

(72) Inventor: Daniel Patrick Morris, West Hills, CA (US)

( * ) Notice: Subject to any disclaimer, the term of this patent is extended or adjusted under 35 U.S.C. 154(b) by 0 days.

(21) Appl. No.: 16/441,808

(22) Filed: Jun. 14, 2019

(65) Prior Publication Data

US 2020/0392739 A1 Dec. 17, 2020

(51) Int. Cl.
*E04F 13/08* (2006.01)

(52) U.S. Cl.
CPC ..... *E04F 13/0801* (2013.01)

(58) Field of Classification Search
CPC ..... E04F 13/0801
USPC ..... 248/544, 688, 201, 237, 235, 247, 300; 52/749.1, 712
See application file for complete search history.

(56) References Cited

U.S. PATENT DOCUMENTS 3,554,236 A * 1/1971 Rhodes ..... H02G 3/045 138/117
4,314,429 A * 2/1982 Casteel ..... E04F 13/0864 33/647
4,314,687 A * 2/1982 Logsdon ..... E03C 1/021 248/610
5,366,329 A 11/1994 Burgess
5,564,236 A * 10/1996 McKinney ..... E04F 21/185 52/127.2
5,658,113 A * 8/1997 Lazo ..... E04F 21/185 414/11
6,131,361 A 10/2000 Murphy
6,161,824 A 12/2000 Gustavson
6,237,300 B1 * 5/2001 Carne ..... E04B 2/58 52/715
6,295,781 B1 * 10/2001 Thompson ..... E04B 1/2608 403/232.1
6,364,404 B1 4/2002 De Paoli
6,467,236 B1 10/2002 Schlegel
6,609,344 B2 * 8/2003 Saldana ..... E04B 1/2403 52/243
6,622,438 B2 * 9/2003 Hurlock ..... E04F 21/185 248/200
6,886,790 B2 * 5/2005 Soyris ..... B64G 1/58 244/159.1
6,904,732 B1 * 6/2005 Richmond ..... E04F 21/185 52/127.1
7,117,972 B2 * 10/2006 Mattson ..... E05F 15/668 181/209
7,578,101 B2 * 8/2009 Ganske ..... E04F 21/185 248/544

(Continued)

*Primary Examiner* — Terrell L McKinnon
*Assistant Examiner* — Michael McDuffie
(74) *Attorney, Agent, or Firm* — Louis F. Teran

(57) ABSTRACT

The present invention is a construction panel mounting apparatus that temporarily secures a wall or ceiling panel in position until the installer can permanently secure it. The construction panel mounting apparatus of the present invention accommodates various size panels and essentially eliminates the need of a person to temporarily hold the panel in place while another permanently secures it. In addition, the construction panel mounting apparatus of the present invention also serves as a panel foot lift that facilitates the lifting of heavy panels from the floor.

5 Claims, 12 Drawing Sheets

(56) References Cited

U.S. PATENT DOCUMENTS

| | | | | |
|---|---|---|---|---|
| 7,584,586 | B2 * | 9/2009 | Decker | E04F 21/185 248/351 |
| 7,694,464 | B2 * | 4/2010 | Garcia | E04F 21/185 52/94 |
| 8,511,630 | B2 * | 8/2013 | Varieur | G08B 5/38 248/300 |
| 8,549,816 | B2 * | 10/2013 | Roberts | E04F 21/185 52/749.1 |
| 8,667,765 | B1 * | 3/2014 | McCarthy | E04F 13/0841 52/745.1 |
| 2005/0214502 | A1 * | 9/2005 | Westthorp | E04F 21/0092 428/98 |
| 2010/0083605 | A1 * | 4/2010 | Wallner | B27J 1/00 52/655.1 |
| 2010/0146903 | A1 * | 6/2010 | Ellis | E04B 2/7457 52/696 |
| 2014/0021313 | A1 * | 1/2014 | Gagne | F16M 13/02 248/205.1 |
| 2015/0375686 | A1 * | 12/2015 | George | B60R 9/06 248/201 |
| 2016/0200018 | A1 * | 7/2016 | Make | B29C 70/48 264/571 |

* cited by examiner

CONSTRUCTION PANEL MOUNTING APPARATUS

BACKGROUND OF THE INVENTION

Field of the Invention

The present invention relates generally to the field of installation of building materials, and more particularly, to an apparatus that temporarily secures a wall or ceiling panel until the installer can permanently secure the material into position.

Description of Prior Art

Wall and ceiling panels are typically composed of a layer of gypsum sandwiched between two layers of heavy paper. The panels are known various as "wallboard", "drywall", etc. The panels are typically constructed and sold in four foot by eight foot sections having a thickness of ¼ inch, ⅜ inch, lit inch, or ⅝ inch. Installation of the panels onto a wall or a ceiling can be very cumbersome and labor intensive primarily because of their size and weight. For example, a ½ inch panel weighs approximately 50 pounds and a ⅝ inch panel weighs approximately 70 pounds. The size and weight of the panels make them very difficult to be installed by a single individual without assistance. Installation typically requires at least two individuals, one that lifts and holds the panel temporarily into position while the other permanently secures the panel in position typically using screws, nails, and/or adhesives. This practice is dangerous, cumbersome, and costly. Therefore, there is a need for an invention that can temporarily hold a panel in place while the installer makes final adjustments and permanently secures the panel in place onto a wall or ceiling.

One method that is often used involves the use of a drywall lift that raises drywall into position. A disadvantage to this method is that the drywall lift is cumbersome to assemble and disassemble. Installation of panels on different walls require the drywall lift to be disassembled, moved to the next wall, and re-assembled.

U.S. Pat. No. 5,366,329 teaches a rotatable device having an integral "Z" shaped body used to temporarily hold the panel but it does not have the option to be locked in a secure position. This causes a problem when a panel needs to be adjusted to properly fit when abutting another panel. Furthermore, U.S. Pat. Nos. 6,131,361; 6,161,824; 6,364,404; 6,467,236; and 6,904,732, all describe various brackets that can be attached temporarily to ceiling joists, to wall studs, or to top plates for guiding a panel into place and supporting them while they are permanently secured. All of these brackets fail to effectively secure a panel because they allow a panel to slip off the bracket, they are cumbersome to assemble and disassemble for each panel installed, and they do not accommodate multiple panel sizes.

Therefore, there exists a need for a construction panel mounting apparatus which will overcome the deficiencies of the prior art devices without having its own drawbacks. The construction panel mounting apparatus of the present invention provides a highly practical and satisfactory device which is a significant advance in the art.

BRIEF SUMMARY OF THE INVENTION

Accordingly, the present invention has been made in view of the above-mentioned disadvantages occurring in the prior art and it is the object of the present invention to provide a construction panel mounting apparatus that temporarily secures a wall or ceiling panel until the installer can permanently secure the material into position.

It is another object of the present invention to provide a construction panel mounting apparatus that can accommodate varying panel sizes.

It is yet another object of the present invention to provide a construction panel mounting apparatus that can be readily assembled and disassembled for use with ease.

It is yet another object of the present invention to provide a construction panel mounting apparatus that allows for the position of the panel to be adjusted before it is permanently secured in place.

It is yet another object of the present invention to facilitate the installation of a construction panel by a single individual.

It is yet another object of the present invention to provide a construction panel mounting apparatus that is durable enough to withstand the rigors of a construction site.

It is yet another object of the present invention to provide a construction panel mounting apparatus that can be used with thick panels such as plywood or lumber panels.

It is yet another object of the present invention to provide a construction panel mounting apparatus that facilitates with the lifting of a panel off the ground.

It is yet another object of the present invention to provide a construction panel mounting apparatus that is cost effective and manufacturable.

To accomplish the above objects, the present invention is embodied in a construction panel mounting apparatus comprising a body, preferably a rectangular cube, having various cantilevers and holes. The body is attached to a ceiling joist or wall stud with screws through said holes and the cantilevers temporarily secure one end of the panel to a wall or ceiling while the installer permanently secures it into position.

The above and other features and advantages of the present invention, as well as the structure and usage of various embodiments of the present invention, are described in detail below with reference to the accompanying drawings.

DESCRIPTION OF DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description considered in connection with the accompanying drawings, wherein.

DETAILED DESCRIPTION OF THE INVENTION

Figure 1:
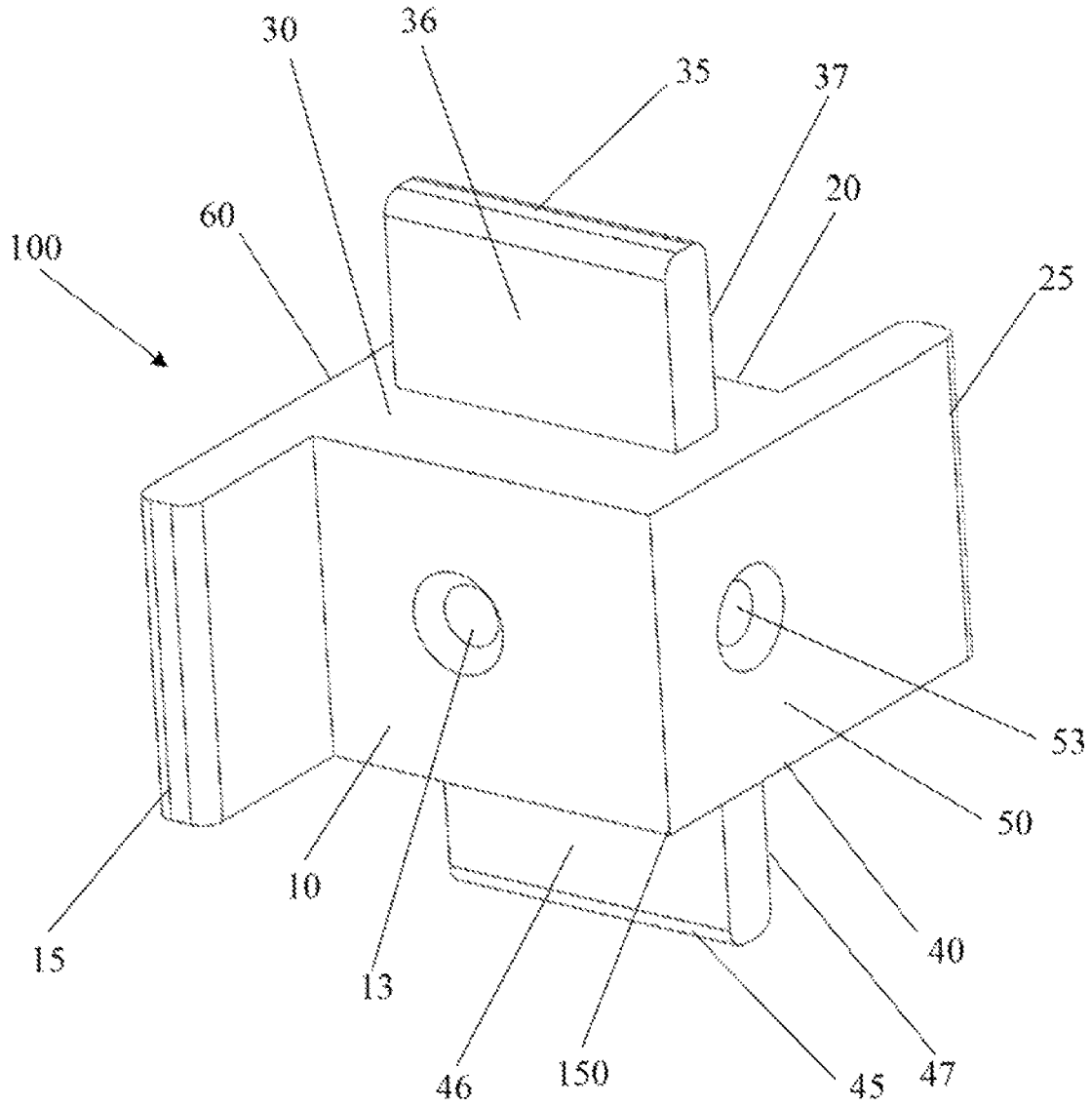
FIG. 1 shows a front perspective view of the construction panel mounting apparatus according to the present invention.
Figure 2:
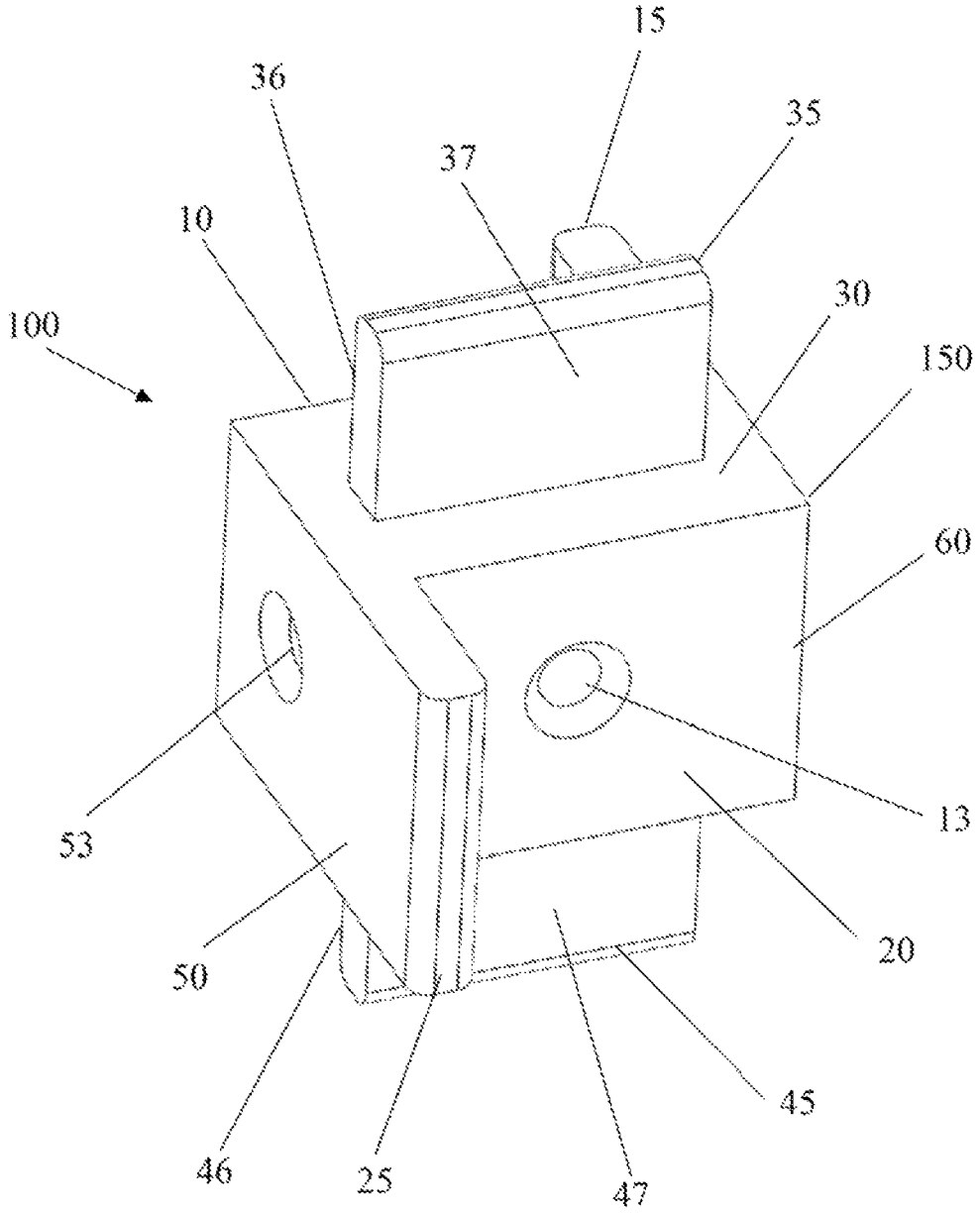
FIG. 2 shows a rear perspective view of the construction panel mounting apparatus according to the present invention.
Figure 3:
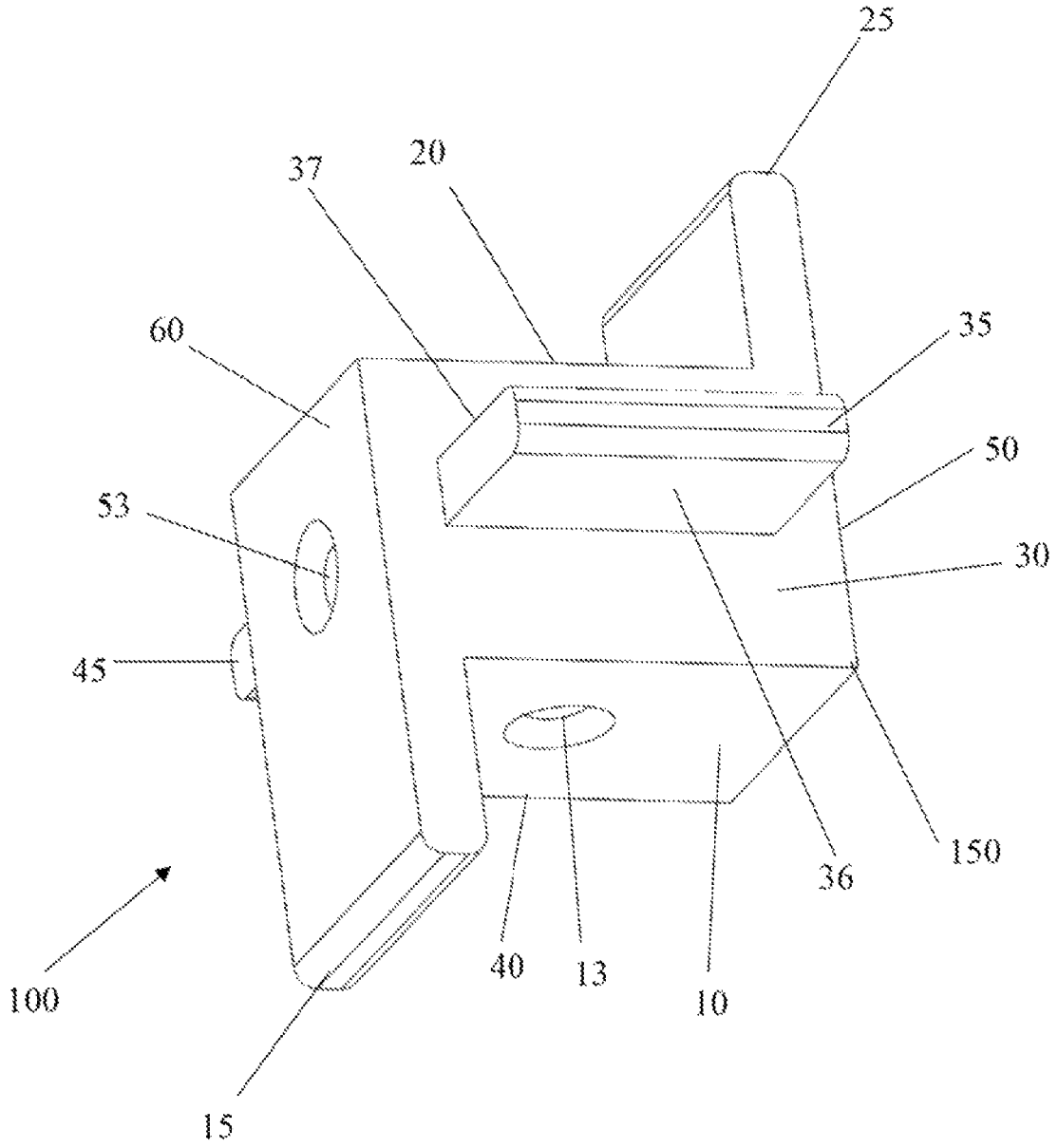
FIG. 3 shows a top perspective view of the construction panel mounting apparatus according to the present invention.
Figure 4:
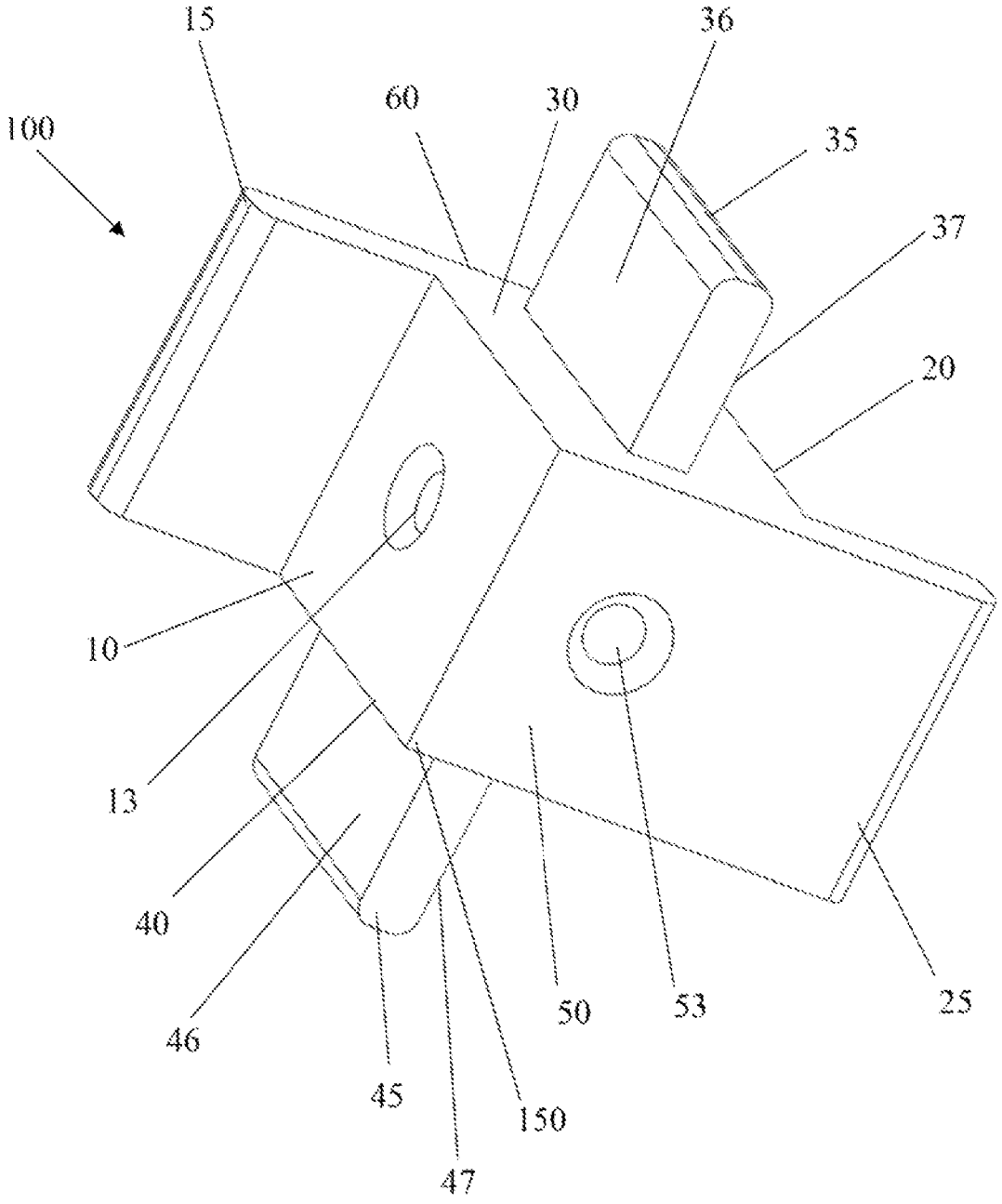
FIG. 4 shows a side perspective view of the construction panel mounting apparatus according to the present invention.

Certain terminology is used in the following descriptions for convenience only and is not limiting. The words "right", "left", "lower", and "upper" designate directions in the drawings to which reference is made. The words "inwardly" or "distally" and "outwardly" or "proximally" refer to directions toward and away from, respectively, the geometric center or orientation of the device and instruments and related parts thereof. The terminology includes the above-listed words, derivatives thereof, and words of similar import.

Although, the present invention can be used in connection with any type of construction panel mounting application, it is especially suited for mounting drywall panels to a wall or ceiling. Accordingly, the present invention will be described herein with reference to drywall panel mounting application. However, the preferred system of the present application may also be adapted for use with other types of panels, such as wood, lumber, metal, plastic, and the like.

Reference will be made to the drawings in which various elements of the present invention will be given numerical designations and in which the invention will be discussed so as to enable one skilled in the art to make and use the present invention.

As shown in FIGS. 1-10, the construction panel mounting apparatus 100 of the present invention comprises a body 150, preferably shaped as a rectangular cube, having a front face 10, a rear face 20, a top face 30, a bottom face 40, a right face 50, and a left face 60. The construction panel mounting apparatus 100 of the present invention further comprises a front cantilever 15 attached to the front face 10, a rear cantilever 25 attached to the rear face 20, a top cantilever 35 attached to the top face 30, and a bottom cantilever 45 attached to the bottom face 40. Finally, the construction panel mounting apparatus 100 of the present invention further comprises a side hole 53 located at the center of the right face 50 that extends linearly through to the left face 60, and a front hole 13 located at the center of the front face 10 that extends linearly through the rear face 20.

Figure 5:
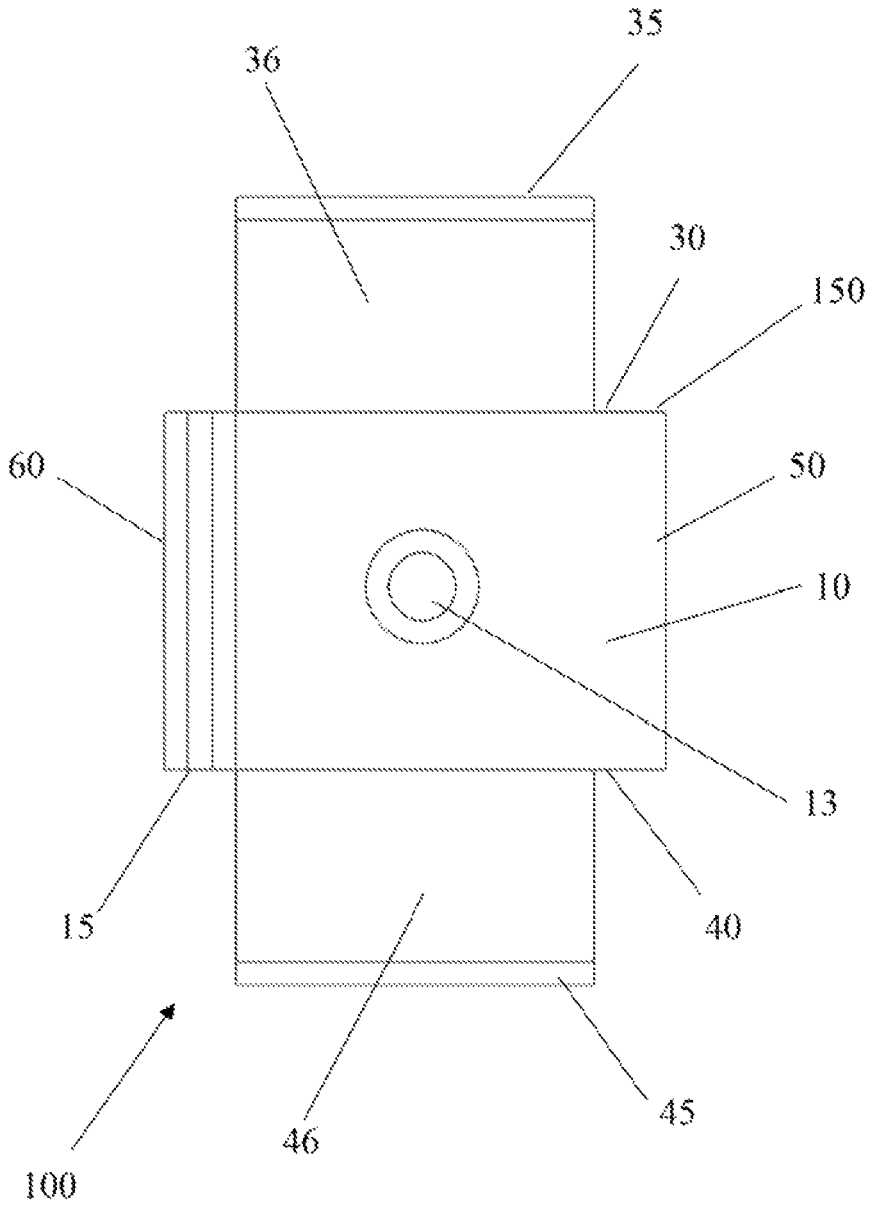
FIG. 5 shows a front view of the construction panel mounting apparatus according to the present invention.
Figure 6:
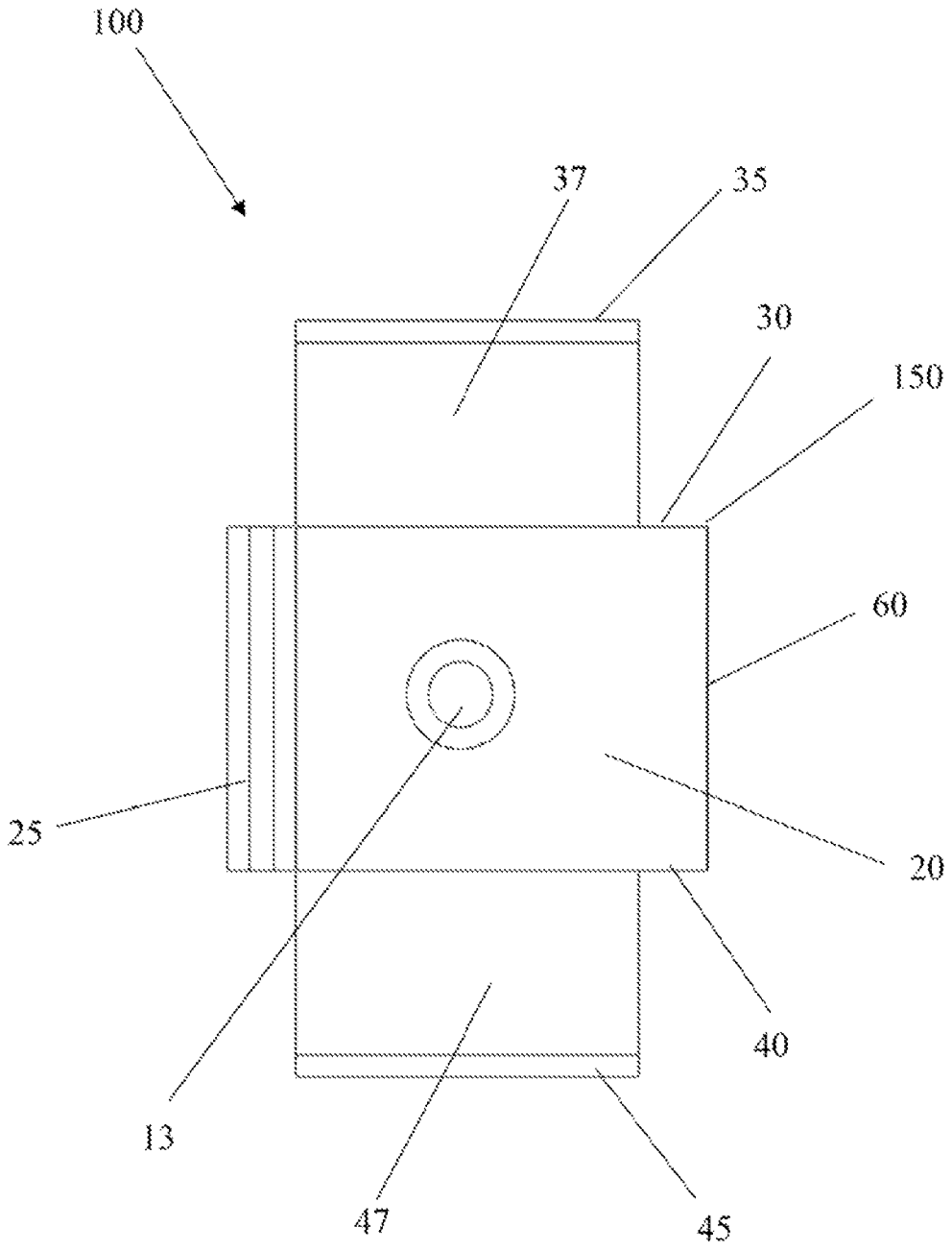
FIG. 6 shows a rear view of the construction panel mounting apparatus according to the present.
Figure 7:
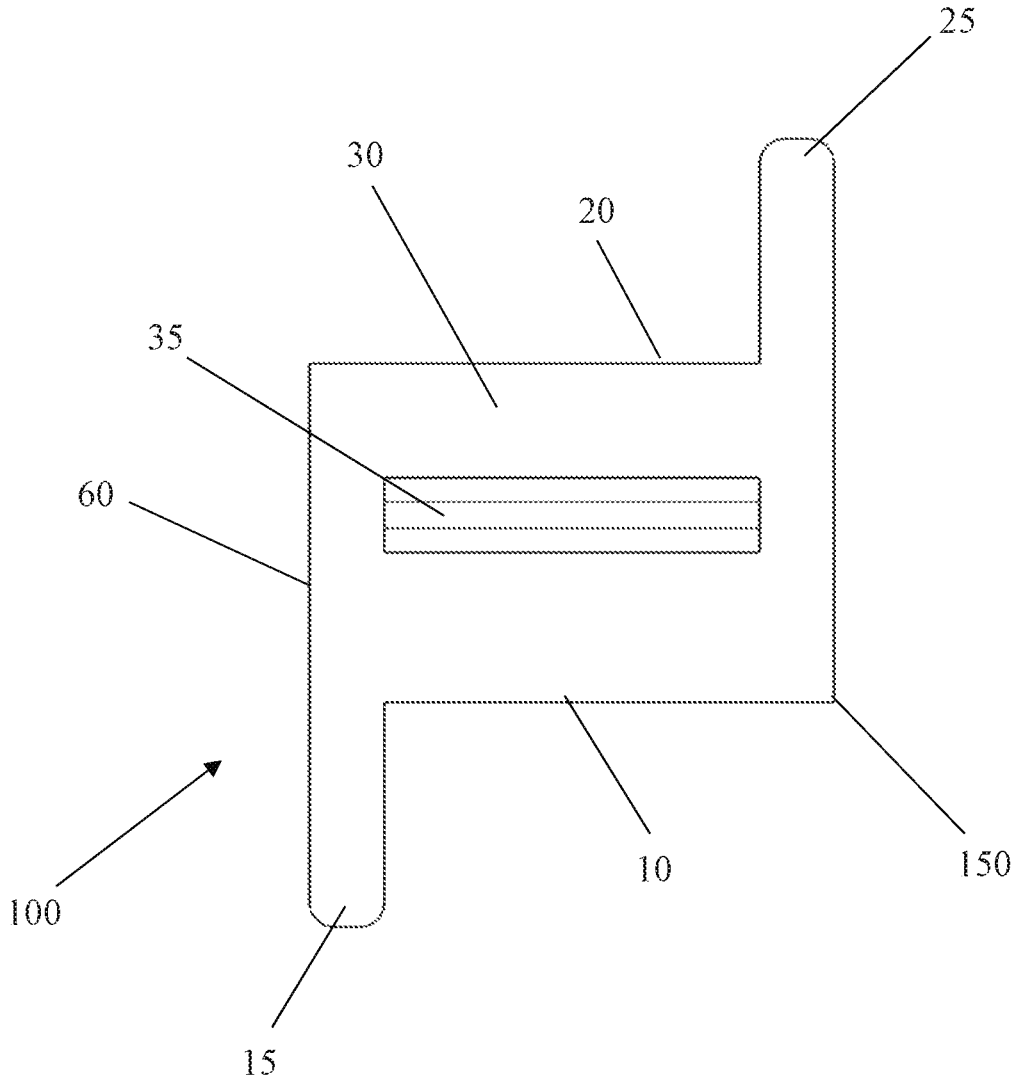
FIG. 7 shows a top view of the construction panel mounting apparatus according to the present invention.
Figure 8:
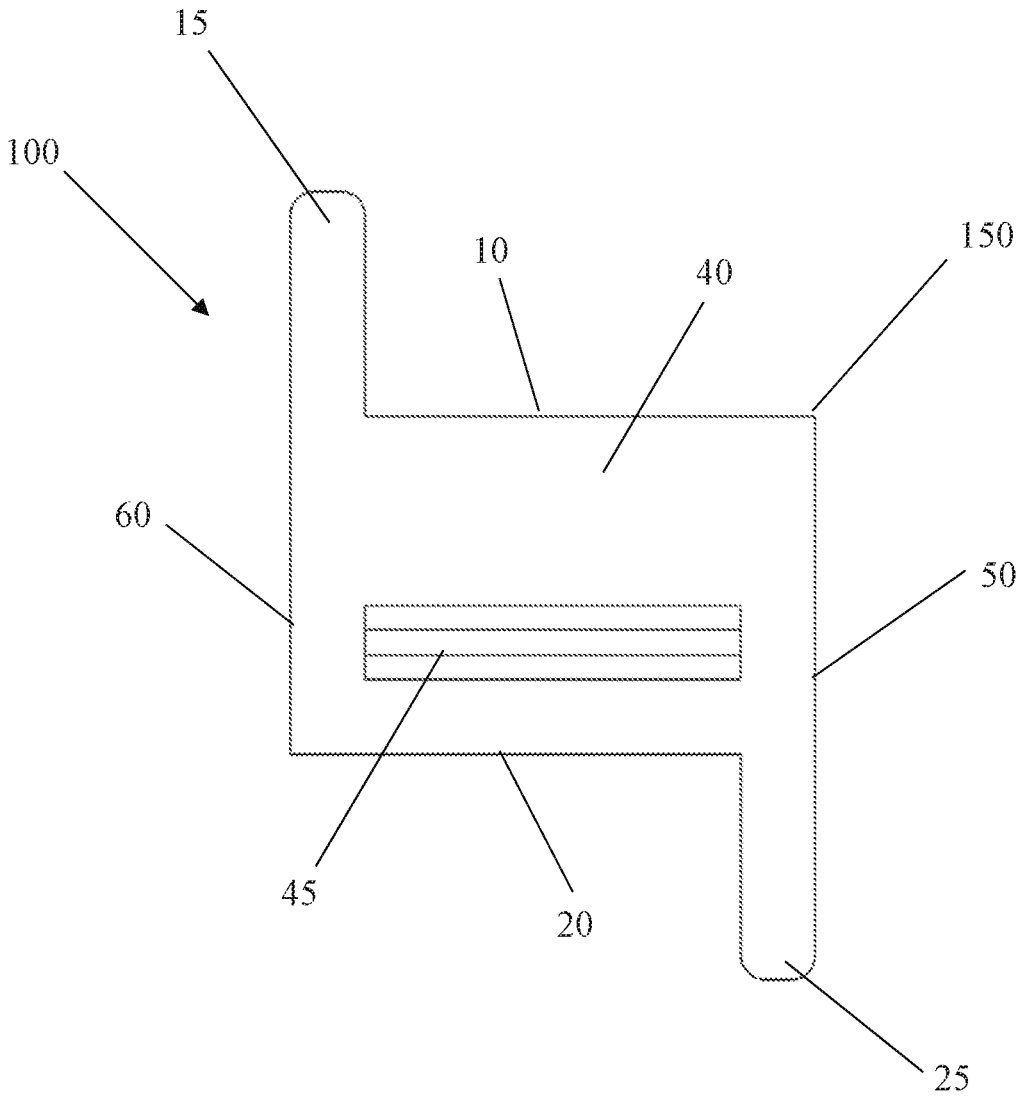
FIG. 8 shows a bottom view of the construction panel mounting apparatus according to the present invention.
Figure 9:
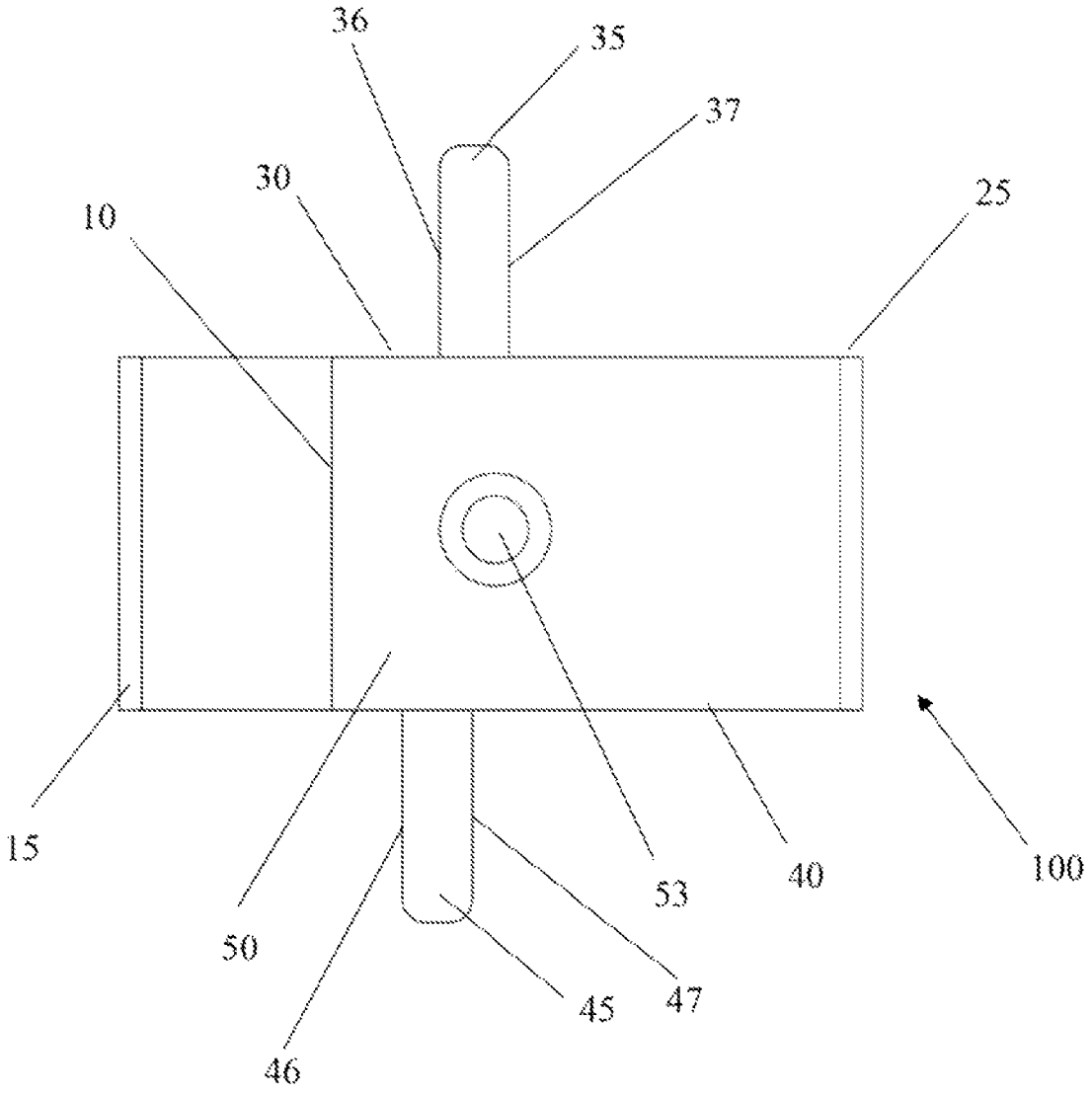
FIG. 9 shows a right view of the construction panel mounting apparatus according to the present invention.
Figure 10:
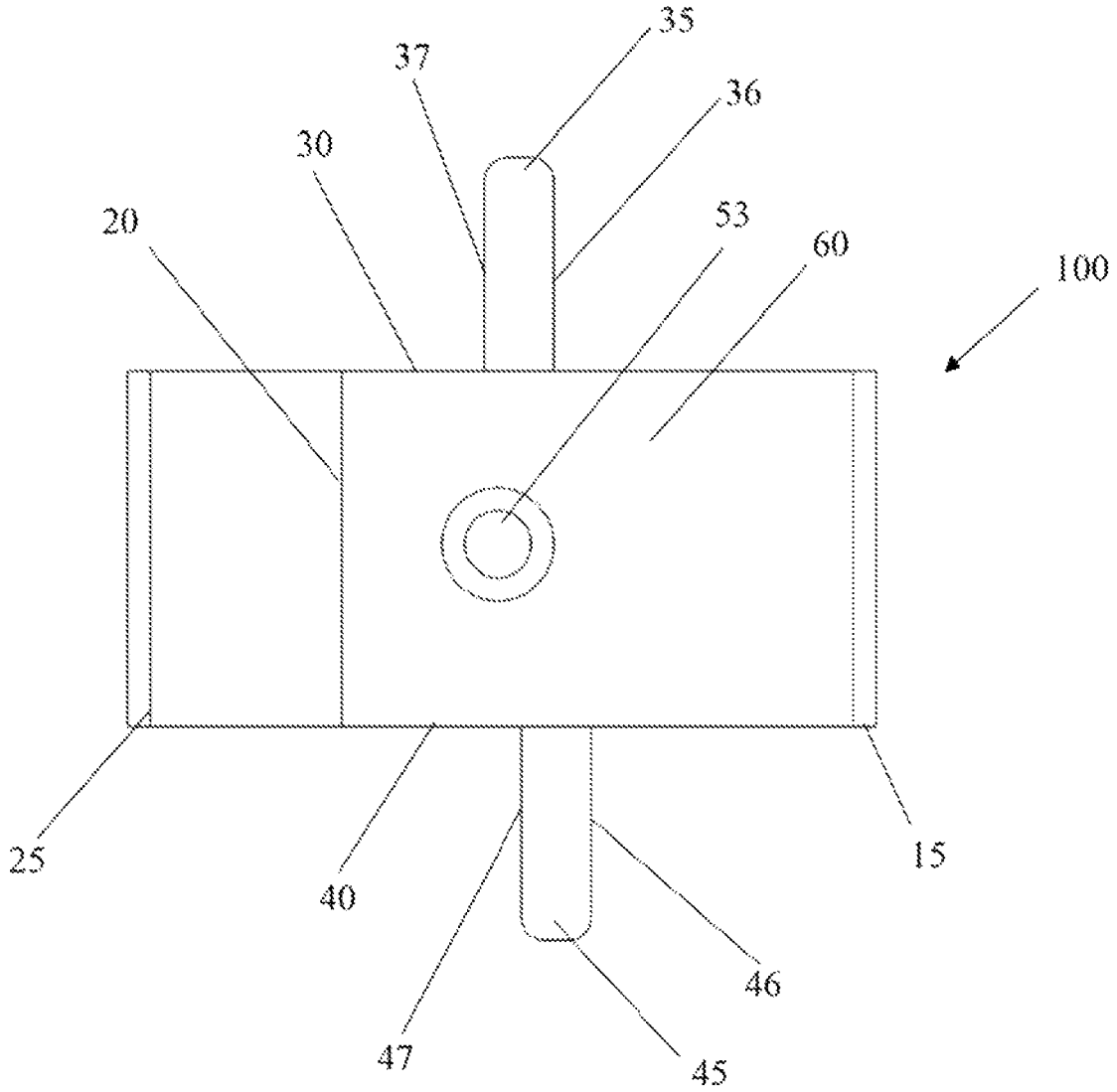
FIG. 10 shows a left view of the construction panel mounting apparatus according to the present invention.

As shown in FIGS. 1, 5, and 7, the front cantilever 15 is attached to and extends from the front face 10 while aligned with the left face 60. Similarly, the rear cantilever 25 is attached to and extends from the rear face 20 while aligned with the right face 50. On the other hand, the top cantilever 35 is attached to and extends from the top face 30. However, the position of the top cantilever 35 on the top face 30 is such where the front side 36 of the top cantilever 35 is ½ inches from the front face 10 while the rear side 37 of the top cantilever 35 is ⅜ inches from the rear face 20. Similarly, the position of the bottom cantilever 45 on the bottom face 40 is such where the front side 46 of the bottom cantilever 45 is ⅝ inches from the front face 10 while the rear side 47 of the bottom cantilever 45 is ¼ inches from the rear face 20.

Hereinafter, an explanation of the methods of using the construction panel mounting apparatus 100 of the present invention will be given.

A construction panel 200 is typically mounted to a wall with screws that are driven through the panel 200 and into wall studs 300. Multiple screws are driven through the panel 200 and into various wall studs 300 to ensure that the panel 200 is installed securely. The size and weight of the panel 200 causes difficulty in holding the panel 200 in the preferred position or alignment until enough screws are installed to secure the panel 200. The process of installing a panel 200 typically requires at least one person to hold the panel 200 in the preferred position or alignment while another person drives the screws into the proper wall studs 300.

The construction panel mounting apparatus 100 of the present invention takes the place of the first person that holds the panel 200 in the preferred position or alignment. First, the thickness of the panel 200 must be determined to determine which cantilever to use. For example, if mounting a ½-inch panel 200, then place the construction panel mounting apparatus 100 of the present invention with the front face 10 abutting a wall stud 300 onto which the panel 200 will be secured. More specifically, the construction panel mounting apparatus 100 of the present invention must be positioned onto the wall stud 300 with the front face 10 abutting the front 310 of the wall stud 300, the front cantilever 15 abutting the side 320 of the wall stud 300, and the top cantilever 35 facing upwards. Once the construction panel mounting apparatus 100 is placed in the preferred position on the wall stud 300, a screw is driven through the front hole 13 and into the wall stud 300 to secure the construction panel mounting apparatus 100 into place.

Figure 11:
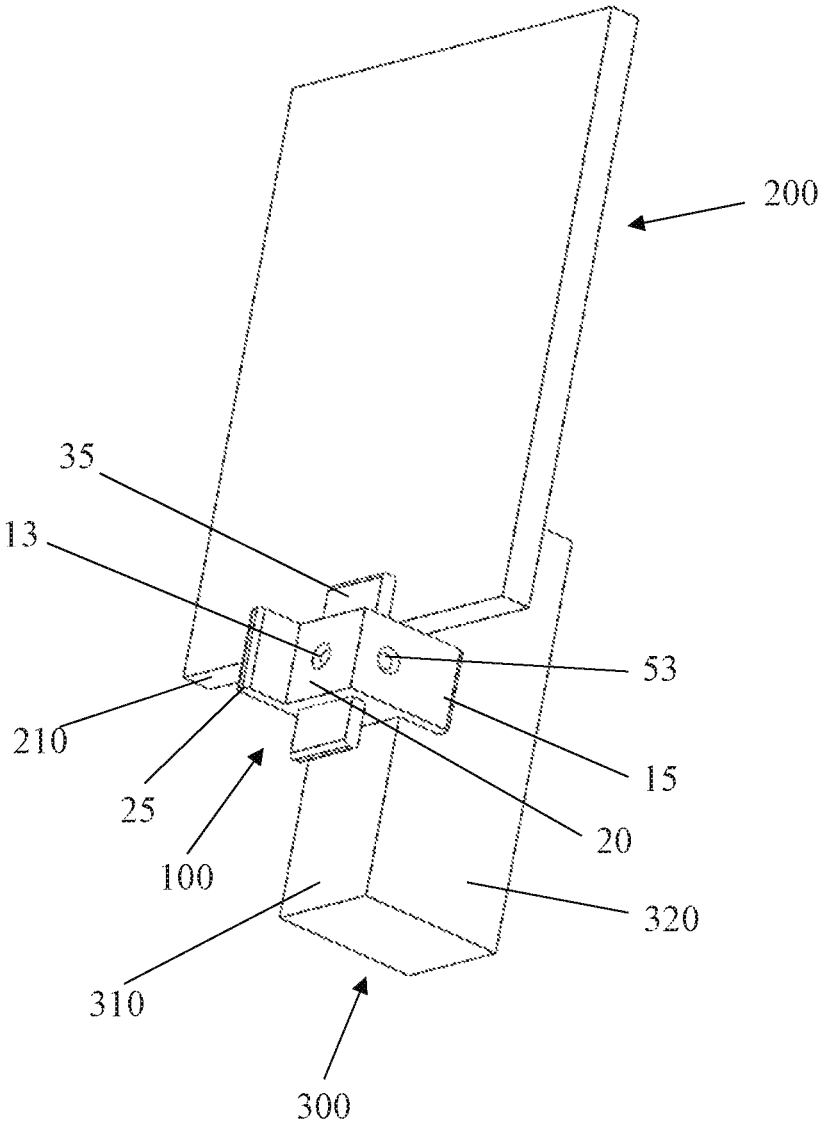
FIG. 11 shows a perspective view of the construction panel mounting apparatus according to the present invention as it is used to mount a drywall panel to a wall.

Then, the panel 200 is placed against the front 310 of the wall stud 300 and allowed to slide down so that its bottom edge 210 slides in between the front 310 of the wall stud 300 and the top cantilever 35. After all the top cantilever 35 is spaced ½ inches from the front 310 of the wall stud 300, enough space to fit a ½-inch panel. Once in place, the panel 200 is temporarily retained in place by the wall stud 300 in the back, the top face 30 in the bottom, and the top cantilever 35 in the front, as shown in FIG. 11. The installer then can slide the panel 200 sideways to adjust to the preferred position. Since the front cantilever 15 abuts the side 320 of the wall stud 300, the top face 30 is square or reasonably perpendicular to the wall stud 300. Essentially, the front cantilever 15 and the rear cantilever 25 serve to square the top face 30 and bottom face 40, respectively, to the wall stud 300, as shown in FIG. 11. Thus, when the installer places and slides the panel 200 to the preferred position, the panel 200 rests on the top face 30 or bottom face 40 making the panel 200 square or reasonably perpendicular to the wall stud 300. Once in the preferred position, the installer can drive screws into the panel 200 and through the wall stud 300 until the panel 200 is permanently secured to the wall stud 300. Finally, the screw retaining the construction panel mounting apparatus 100 is removed so that the apparatus 100 can be re-used with another panel at a different location.

In the same manner as explained above, the construction panel mounting apparatus 100 of the present invention can be used to mount panels of varying thickness. In the example above, the front face 10 and the top cantilever 35 were used to mount a ½ inch panel. Similarly, the rear face 20 and the top cantilever 35 are used to mount a ⅜ inch panel. In a similar manner, the front face 10 and the bottom cantilever 45 are used to mount a ⅝ inch panel. Further, the rear face 20 and the bottom cantilever 45 are used to mount a ¼ inch panel. Even further, the right face 50 and the front cantilever 15 can be used to mount thicker materials, such a 4×2 lumber.

Figure 12:
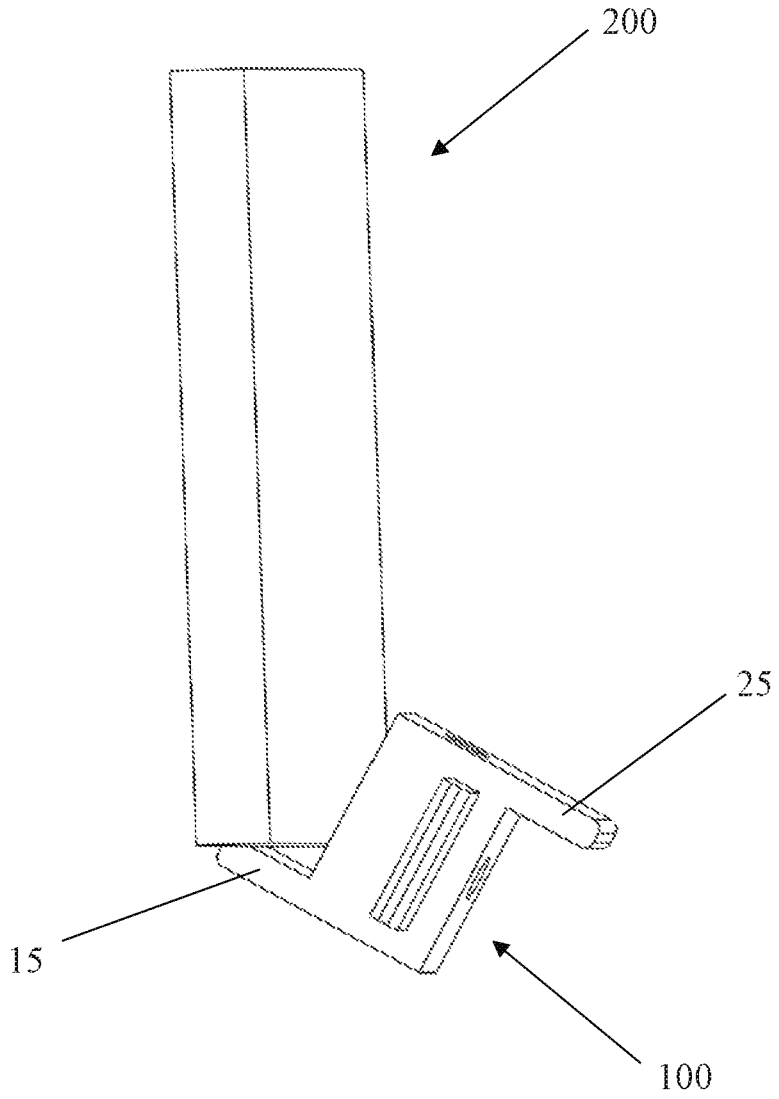
FIG. 12 shows a perspective view of the construction panel mounting apparatus according to the present invention as it is used to facilitate the lifting of a drywall panel off the ground.

A second functional use of the construction panel mounting apparatus 100 of the present invention is that of a typical drywall foot lift. The front cantilever 15 is slid under a panel 200 resting on the ground. Then the user's foot steps on the rear cantilever 25 and presses downward so as to force the construction panel mounting apparatus 100 to pivot as shown on FIG. 12. As the construction panel mounting apparatus 100 pivots, the front cantilever 15 is raised upward causing the panel 200 to lift up off from the ground.

It is understood that the described embodiments of the present invention as discussed above are illustrative only, and that modifications thereof may occur to those skilled in the art. Accordingly, this invention is not to be regarded as limited to the embodiments disclosed, but to be limited only as defined by the appended claims herein.

What is claimed is:

1. A construction panel mounting apparatus comprising:

a body having a front face, rear face, a top face, a bottom face, a right face, and a left face;

a top cantilever extending from said top face and having a front side and a rear side;

a front cantilever extending from said front face and having a left side that is aligned with said left face;

a hole extending from said front face to said rear face; and wherein the distance between said front side of said top cantilever and said front face is a first predetermined value, the distance between said rear side of said top cantilever and said rear face is a second predetermined value, and said first predetermined value is not the same as said second predetermined value.

2. A construction panel mounting apparatus according to claim 1 further comprising a bottom cantilever extending from said bottom face and having a front side and a rear side; and wherein the distance between said front side of said bottom cantilever and said front face is a third predetermined value while the distance between said rear side of said bottom cantilever and said rear face is a fourth predetermined value; and wherein said third predetermined value is not the same as said fourth predetermined value.

3. A construction panel mounting apparatus according to claim 1 further comprising a rear cantilever that extends from said rear face and having a right side that is aligned with said right face.

4. A construction panel mounting apparatus according to claim 2 further comprising a second hole extending from said right face to said left face.

5. A construction panel mounting apparatus according to claim 3 further comprising a second hole extending from said right face to said left face.

* * * * *